United States Patent [19]

Goodboy

[11] Patent Number: 4,469,446

[45] Date of Patent: Sep. 4, 1984

[54] FLUID HANDLING

[75] Inventor: George O. Goodboy, Glendale, Calif.

[73] Assignee: Joy Manufacturing Company, Pittsburgh, Pa.

[21] Appl. No.: 391,664

[22] Filed: Jun. 24, 1982

[51] Int. Cl.[3] ..... B01F 15/00

[52] U.S. Cl. ..... 366/342; 137/896; 138/37; 138/39; 138/42; 98/38 A; 366/338; 261/79 A

[58] Field of Search ..... 366/167, 173, 174, 171, 366/172, 336, 337, 338, 340, 342; 98/38 R, 38 A, 38 B; 138/37, 39, 42; 137/896; 261/79 A; 55/415, 79, 97, 393

[56] References Cited

U.S. PATENT DOCUMENTS 1,022,496 4/1912 Muller .
1,335,348 3/1920 Patrick .
2,059,673 11/1936 Watson .
3,017,249 1/1962 Marsh .
3,386,366 6/1968 Economides .
3,881,900 5/1975 Campbell ..... 55/416
4,255,176 3/1981 Macrow ..... 55/415

*Primary Examiner*—Robert W. Jenkins
*Attorney, Agent, or Firm*—Edward L. Levine

[57] ABSTRACT

Systems for mixing gaseous medium streams at different temperatures are for changing the direction of flow of a stream which alleviate the effect of pressure losses. A plurality of hollow airfoil shaped vanes are positioned within a first gaseous stream, and the second stream is conveyed through the hollow vane and discharged into the first stream through a slot at the trailing edge of the vane. Fixed or movable flow direct the rate and direction of the discharge flow.

6 Claims, 7 Drawing Figures

FIG. 3A
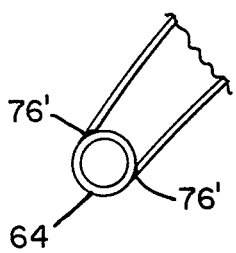
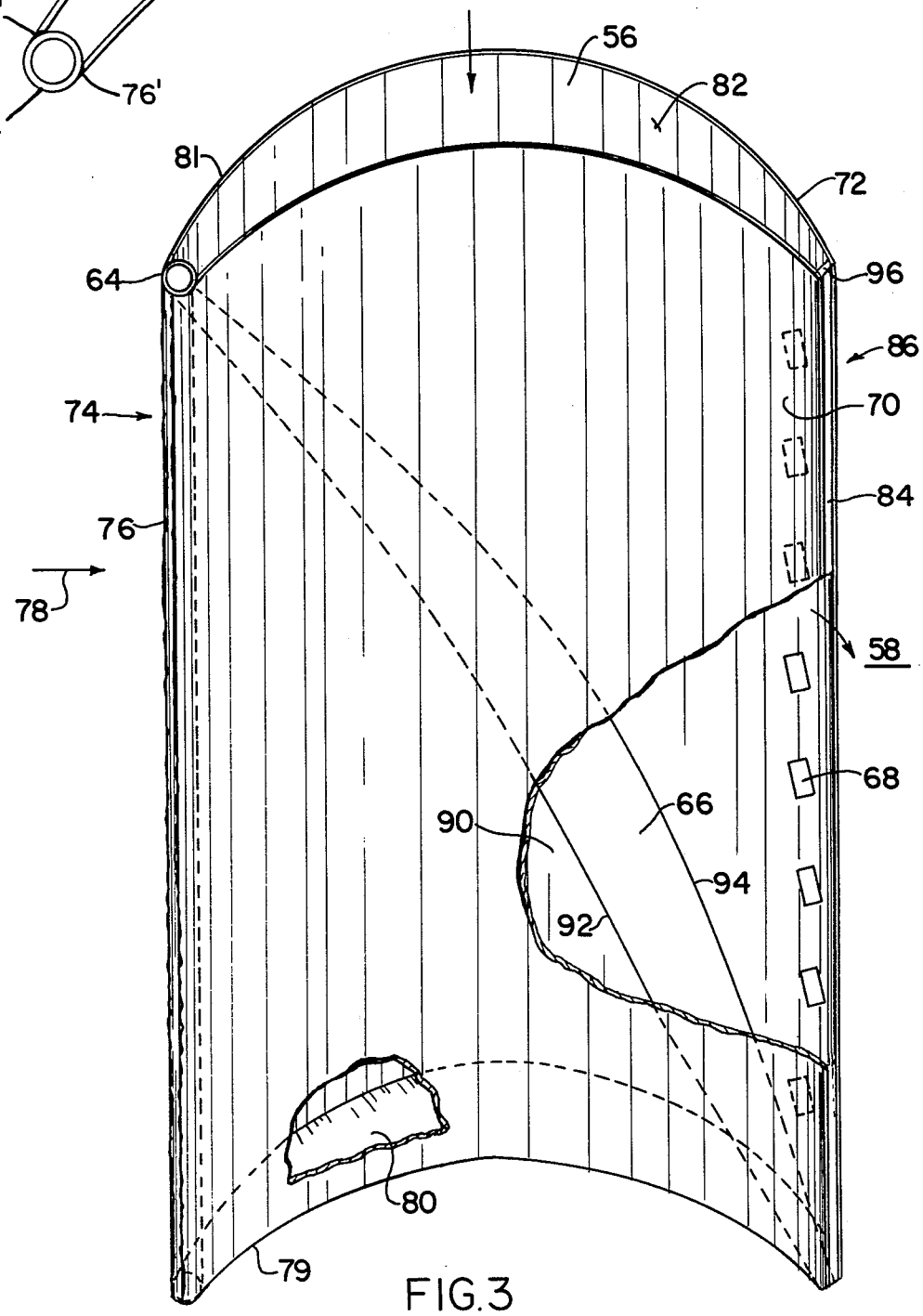
FIG.3

FLUID HANDLING

FIELD OF THE INVENTION

This invention relates to systems for mixing streams of gaseous mediums at different temperatures or densities and for changing the direction of flow of at least one of the streams, particularly applicable to systems for turning and mixing a cooler primary stream of flue gas with a hotter secondary flue gas stream upstream of a particulate removal device.

BACKGROUND OF THE INVENTION

Flue gas treatment systems are utilized in connection with many industrial applications, such as the treatment for removal or neutralization of certain chemical species and particulates from the gaseous medium discharged from a fossil-fired generating system. A typical system processes the major portion of the dirty flue gas in parallel through a plurality of reactors, such as spray-drier absorbers, combines the outlet flow from the reactors, and subsequently passes the combined stream through additional ductwork to particulate removal apparatus such as a baghouse or an electrostatic precipitator. A minor portion of the flue gas, approximately 10%, bypasses the reactors and is mixed with the combined stream upstream of the baghouse in order to ensure a sufficiently high discharge temperature from the baghouse so as to avoid condensation of the cleaned gas in a downstream discharge stack. The streams discharged from the reactors flow within ducts and typically the direction of flow of at least some of the streams must be turned prior to entry into the baghouse.

The turning and mixing functions have been performed separately. For example, turning is often effected through T-shaped, L-shaped, or obliquely angled sections of the ductwork, and has also included the provision of L-shaped or curved deflectors of singular width, so called single element deflectors, positioned within the ductwork. The mixing function has been carried out through configurations such as a T-shaped interconnection of a duct conveying the bypass stream into another duct conveying the combined stream. This interconnection has also included an angle connection, for example, discharge of the bypass stream at an acute angle with respect to the combined stream. Entry of the bypass stream can occur upstream or downstream of the initial mixing and/or turning of the gaseous medium discharged from the reactors. Concentric ducts have also been utilized whereby the bypass stream flowing in an interior duct is discharged into the primary stream in the same direction as the flow of the primary stream.

While such systems have operated for their intended purposes, improvements can be made. For example, the extent of mixing of the bypass and major streams, which are at different temperatures, can be less than desired and result in stratification or other temperature profile distortions. This is particularly a concern where spatial limitations do not provide a sufficient distance downstream of the point of mixing prior to entry into the baghouse or precipitator to allow for complete mixing. Even where large transport lengths are available, it is known that although the systems operate in a turbulent regime, the widths of the ducting are so large that distinctive bands of turbulence occur which are not sufficiently violent across the entire cross section of the duct to allow for adequate mixing. Distortions in the temperature profile further complicate control of the overall flue gas cleaning system. Additionally, the various means utilized for turning the direction of flow inevitably induce undesirable pressure drops in the flue gas treatment system. And, injections of a hot flue gas containing corrosive species, such as sulphur dioxide, have been found to cause localized corrosion at the injection region.

It is thus desirable to provide improved systems for mixing of streams of gaseous mediums at different temperatures. It is also desirable to provide improved systems for turning of gaseous streams in flue gas or other gaseous medium conveying and treatment systems. Preferably such improvements will moderate pressure drops and provide the capability for substantial mixing, particularly within a confined area.

SUMMARY OF THE INVENTION

This invention provides systems for turning or changing the direction of flow of a primary fluid or gaseous stream at one temperature and mixing with the primary stream a secondary stream at another temperature or density. The system is particularly applicable to flue gas treatment systems where alleviation of pressure drops is of substantial value and where it is desireable to mix a secondary or bypass hot gaseous stream with a primary, relatively cooler, gaseous stream. The disclosed systems beneficially combine the flow turning and the flow mixing functions.

In a preferred form one, or preferably a plurality of turning and injecting vanes are positioned to change the direction of the flow of the cooler primary stream discharged from a spray dryer in a flue gas treatment system. The vanes are positioned in the ductwork conveying the primary stream and are externally configured as airfoils, having a leading edge and a trailing edge. The aerodynamic external shape alleviates excessive pressure drops typically attendent the turning of fluid streams.

The vanes include a generally hollow interior space, and preferably are elongated in the length perpendicular to the airfoil shaped cross section. The length of the vanes can thus be disposed completely across the height or width of a duct conveying the primary gas to be turned. The vanes can be vertically positioned, hung from the top, and merely guided at the bottom so that the vanes remain in tension and can readily accommodate thermal expansions. The vanes also include an inlet opening at one end, for example the top, of the airfoil shaped cross section. Preferably the opening encompasses the entire cross section, and the opposite end is closed.

The downstream or trailing edge of each vane includes one or more slots of selected length. The bypass stream is manifolded from a singular plenum into the inlet openings of each vane, flows through and is turned within the interior of the vane, and is discharged at the trailing edge, mixing with the primary stream. Where, for example, the trailing edge includes a singular slot along its entire length, which extends across the complete cross section of the ductwork, the two gaseous streams are advantageously mixed across the entire cross section of the duct.

In some instances it is desirable to discharge the bypass stream parallel to the direction of flow of the primary stream in one plane, but at an angular direction with respect to a cross section of the vane. For example, where the vanes are vertically oriented, that is, where the length dimension is vertical and the turning occurs in a generally horizontal plane, it can be beneficial to discharge the hotter bypass stream such that its directional vector includes a downward component. This will assist mixing as the hotter gas discharged has a tendency to rise downstream of the initial mixing region at the trailing edge. A plurality of flow guides or fins are accordingly disposed within the interior of the vanes to deflect the bypass flow in the desired direction.

In a flue gas treatment system, the bypass gas flowing through the vanes contains particulate matter which can undesireably collect or stagnate on horizontal surfaces. The vanes preferably include a sloping baffle plate within the interior space to deflect potential particulate buildup outwardly through the slotted discharge. In the exemplary vertical orientation described above, the baffle also serves to provide a more uniform velocity profile for the gaseous discharge along the length of the slotted trailing edge. An adjustable insert can also be incorporated to selectively control the discharge of the bypass gas during operation, for example, to selectively deflect the flow.

The interior space can also include structurally supporting stiffening elements to ensure retention of the shape of the vanes.

BRIEF DESCRIPTION OF THE DRAWINGS

The advantages, nature and additional features of the invention will become more apparent from the following description, taken in connection with the accompanying drawings, in which:

FIG. 3 is a perspective view of a vane in accordance with the invention;

FIg. 3A is a top view of a portion of the vane of FIG. 3;

Referring now to FIG. 1 there is shown an exemplary flue gas treatment system 10. Flue gas refers to any gaseous medium which is to be treated so as to change its temperature, density and/or its composition through addition or removal of chemical species. A typical exemplary system includes apparatus for treating the gaseous particulate mixture discharged from a fossil fired generating station for neutralization of chemical species and removal of particulate matter.

Figure 1:
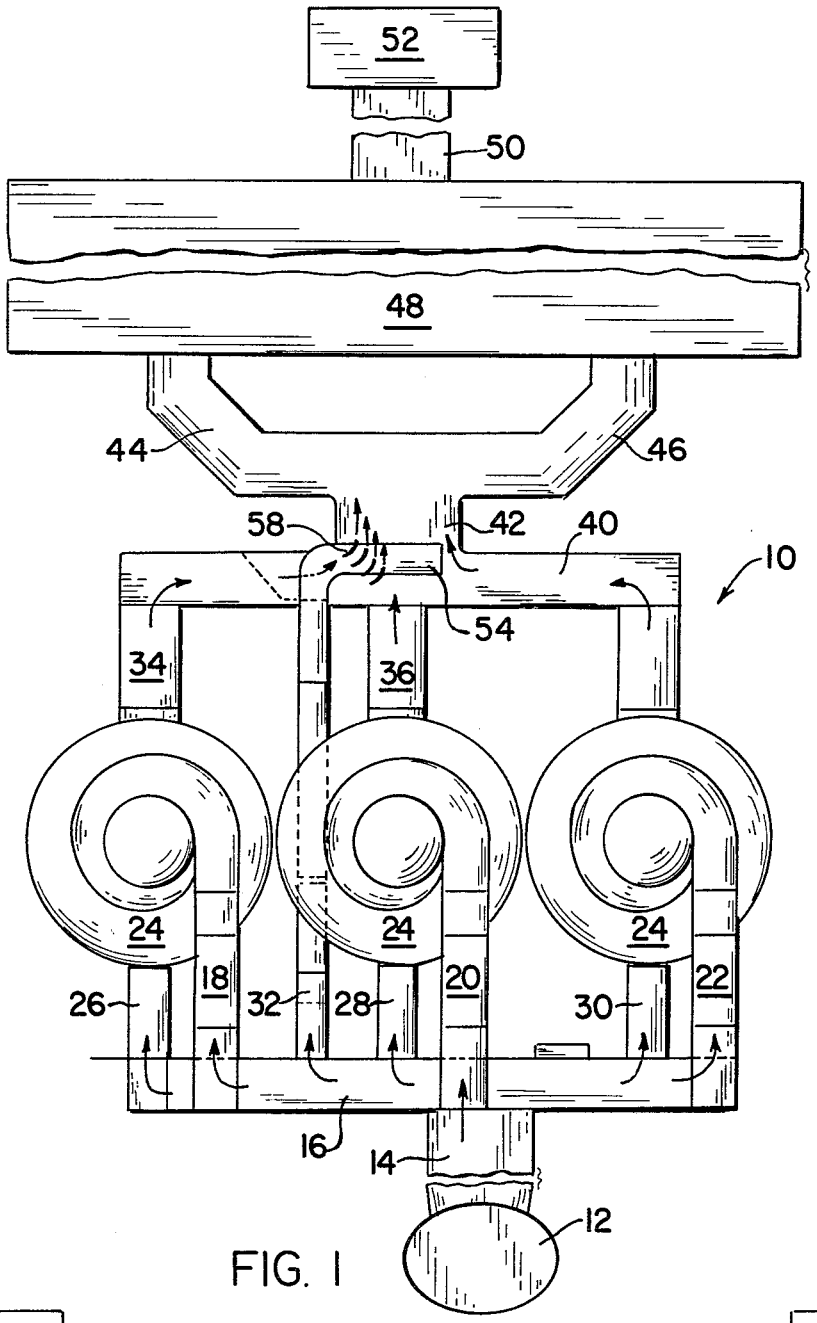
FIG. 1 is a schematic plan view of an exemplary flue gas treatment system in accordance with the invention.

In the exemplary system, flue gas is discharged from a station 12 and flows through a duct 14 to a carrier duct 16. From the carrier duct 16 the gaseous medium flows through parallel ducts 18, 20, 22 to the inlets at the top of reactors such as atomizer-type spray dryer-absorbers 24 wherein species such as sulfur dioxide are reacted with an alkaline medium. A portion of the gaseous medium can also be selectively directed through dampers (not shown) into a lower region of the spray dryer absorbers 24 through ducts 26, 28, 30. It will be recognized that portions of the ducting shown in FIG. 1 are at differing elevations, and certain interconnections are not shown.

A minor, secondary portion of the flue gas flows from duct 16 through a bypass duct 32, and thus bypasses the reactors 24. The primary, major portion of the flue gas flows from the reactors 24 through parallel ducts 34, 36, 38 into another carrier duct 40. From the carrier duct 40 the primary stream of the gaseous-particulate medium discharged from the reactors 24 is turned 90° into a mixing duct 42 and split to flow into ducts 44, 46 for entry into particulate removal apparatus such as a baghouse 48. In the baghouse 48 particulates are removed and cleaned gas flows through a duct 50 to a discharge stack 52.

Figure 2:
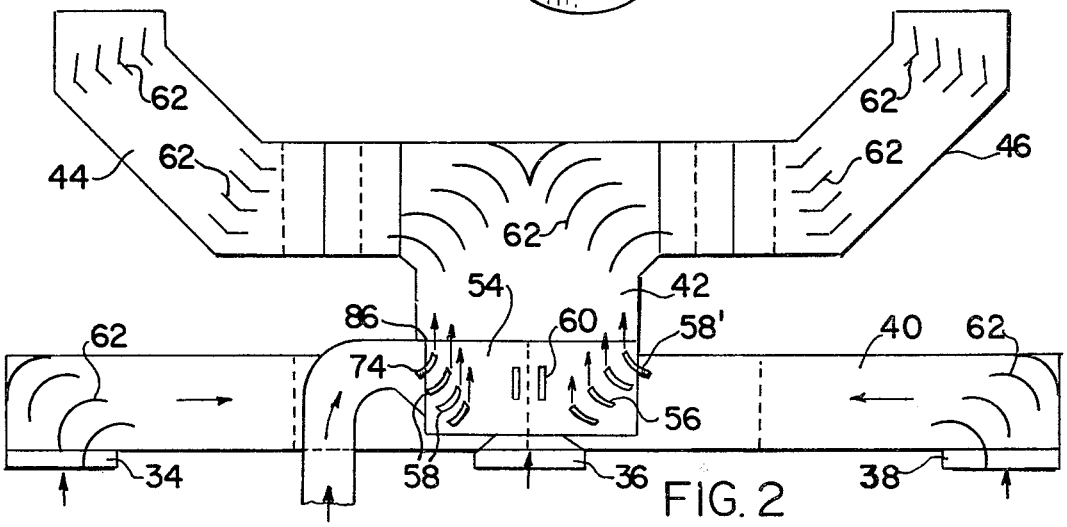
FIG. 2 is an enlargement of a portion of the system of FIG. 1, showing additional detail.

Bypass gas flowing through the duct 32 is directed to a plenum 54 which is in fluid communication with an interior space 56 (FIGS. 2 and 3) of each of the plurality of turning and injecting vanes 58. The plenum 54 also directs the bypass gas medium to straight injecting vanes 60. As shown in FIG. 2, arcuate and angular single element vanes 62 can also be utilized throughout the ductwork. It will be recognized that in the exemplary system 10, the bypass medium, is hotter than the gaseous medium discharged from the reactors 24.

The vanes 58, shown best in FIG. 3, are externally configured aerodynamically, to turn the primary gaseous medium stream while alleviating pressure losses, and are referred to as airfoil shaped. The vanes 58 can be hollow, but preferably include components such as a structural support 64, a baffle 66 and flow guides 68.

Figure 4:
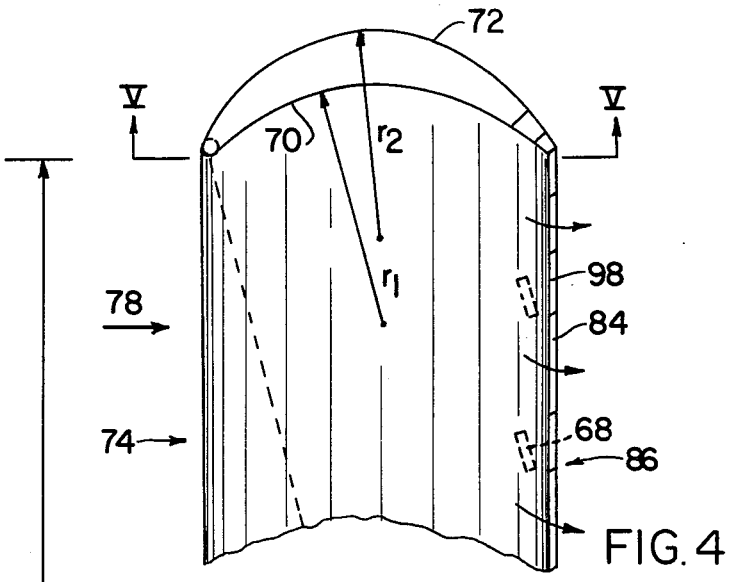
FIG. 4 is a plan view of another embodiment of a vane in accordance with the invention.
Figure 5:
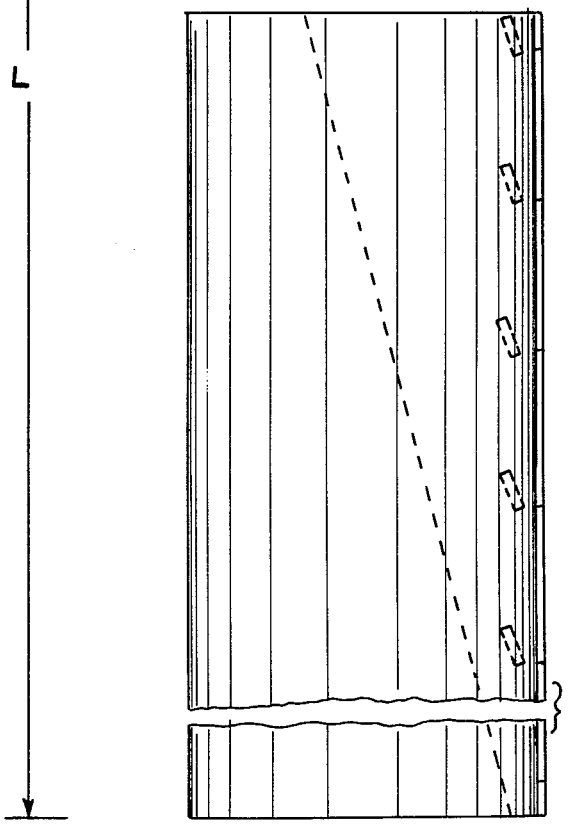
FIG. 5 is a view taken at V—V of FIG. 4.

As shown in FIG. 4, the vane can be fabricated from an interior shell 70 of radius $r_1$ and an exterior shell 72 of radius $r_2$. The shells 70, 72 are preferably separately fabricated from sheet metal, for example one-quarter inch thick mild steel, which exhibits sufficient abrasion resistance upon exposure to the mixed gaseous-particulate medium. If the vanes are to operate in an environment wherein the operating temperature and the gaseous medium exhibit a corrosive effect, other well known materials will be utilized. The shells 70, 72 are preferably joined at an upstream or leading edge 74, such as by a weld 76 (FIG. 3). The shells can also be joined directly to the pipe 64 through welds 76'. The direction of flow of the gaseous medium approaching the vane 58 is indicated in FIGS. 3 and 5 by the arrows 78. A typical vane 58 for use in the exemplary flue gas treatment system 10 can include an inner shell radius $r_1$ of 2.9835 feet, an outer shell radius $r_2$ of 2.4885 feet, and a length L of sixteen feet.

The vanes 58 preferably include at one end 79 of their length a bottom plate 80, welded or otherwise affixed to the shells 70, 72, and an opening 82 at the other end 81. The opening provides means for inletting a gaseous medium, such as the bypass gas, into the interior space 56. One or more slots 84 of preselected length are formed at a downstream trailing edge 86 of the vane 58. The slot 84 provides means for discharging the previously inletted gaseous medium from the interior space 56 into the primary gaseous medium stream. The end 81 of the vane 58 can include a cover plate with an opening 82 therein, or a partial plate covering a selected portion of the cross section at that end 81. For example, where spatial or other constraints are such that the plenum 54 does not directly cover the entire cross section of the vane 58, such as shown at vane 58' of FIG. 2, a covering plate 88 is affixed across a portion of the end 81. Alternatively, an adapter duct section between the body of the plenum and the vane can be formed.

The baffle 66, where utilized, is preferably sealingly affixed within the vane 58 to create a sealed hollow region 90. The baffle 66 provides added structural support to the vane 58, and is positioned at an angle to eliminate exposure of the bypass gas to a surface, the top of the bottom plate 80, where particulate matter could detrimentally collect. The baffle 66 also serves to deflect the inletted gaseous stream toward the discharge slots 84, and to generally equalize the flow distribution through the slot along the length of the vane 58. To fabricate a vane 58 with a baffle 66, one edge 92 of the baffle 66 is initially welded to one of the shells 70, 72 and a groove is cut in the other shell to receive the other edge 94 of the baffle. The groove is cut through the thickness of the shell at periodic placements, so that the edge 94 can be welded to the shell from the exterior, subsequent or prior to joining of the shells at the weld 76. Additional vane supports can be utilized, such as a bar 96.

The flow guides 68 be affixed within the vane 58 to direct the discharge flow at an oblique angle with respect to the slots 84, to further enhance or control mixing of the primary and secondary gaseous medium streams. The guides are preferably welded to one of the shells 70, 72 prior to affixing of the shells, and are tack welded from the exterior, through the slots 84, subsequent to joining of the shells.

FIG. 5 shows a plurality of sheets 98 affixed at selected intervals along the trailing edge 86 which form the plural slots 84 and individually or in cooperation with the flow guides 68, direct the discharge flow in a predetermined fashion. In this manner the secondary bypass stream can be discharged generally parallel to the direction of flow of the primary stream in, for example, a vertical plane, and at an acute, for example, downward angle with respect to a horizontally moving primary stream. The flow guides can be configured to provide vectors representative of the bypass discharge at a desired angle in a selected plane. It will now be apparent that as the secondary bypass stream is discharged from the vanes 58 at the trailing edge, good mixing is achieved due to the high vorticity formed by the wake of the primary stream at the trailing edge, while limiting the effect of pressure losses.

The vanes 58 are preferably positioned with the elongated length L vertically extending from the plenum 54 to the bottom of a horizontally extending duct within which the primary stream is flowing. The vanes are thus perpendicular to the horizontal direction of flow of the primary stream. The bottom of the duct is preferably provided with a receiving groove or extensions configured and positioned to receive and laterally support the bottom of the vanes 58, thus allowing for axial thermal expansion while allowing the vanes to remain in tension. The vanes can also be positioned horizontally, for example, where the primary flow is to be turned upwardly or downwardly. In the vertical orientation the bypass gas stream inlet end 81 of the vanes is welded or otherwise affixed to the plenum 54. This connection is preferably sealed.

There has been described by way of example a system including a combined injector and turning vane useful for turning a flowing primary gaseous stream and for mixing a secondary stream, at a different temperature, with the primary stream in a manner which alleviates pressure drops and provides enhanced mixing. The hollow core slotted vanes induce relatively low pressure loss characteristics as a result of the generally airfoil shaped exterior configuration. The vanes also serve as a non-obstructing conduit for injection of the secondary gaseous stream. The secondary stream can be discharged into the primary stream through a plurality of thin streams or jets, advantageously enhancing mixing. With means for selectively biasing the direction of the injection, such as flow guides, the desired mixing can be adjusted to meet selected distribution criteria or profiles. Injection made directly into the wake of the primary stream, a region of high vorticity, also contributes to good mixing. At the same time, discharge into the wake in a direction in a primary plane generally the same as the direction of flow of the primary gaseous medium stream moderates potential energy losses. Improved mixing also moderates localized corrosive effects. The vanes can readily be positioned such that the injection extends across the entire cross section of the conduit system conveying the primary gaseous stream, thus alleviating the potential for undesirably occurring bands of relatively low turbulence which lessen the quality of gaseous mixing. And, as is important in many envisionable practical applications, the distance required downstream of the injection to ensure the desired degree of homogeneity or mixing of gaseous mediums at differing temperatures or densities, can be substantially lessened.

Figure 6:
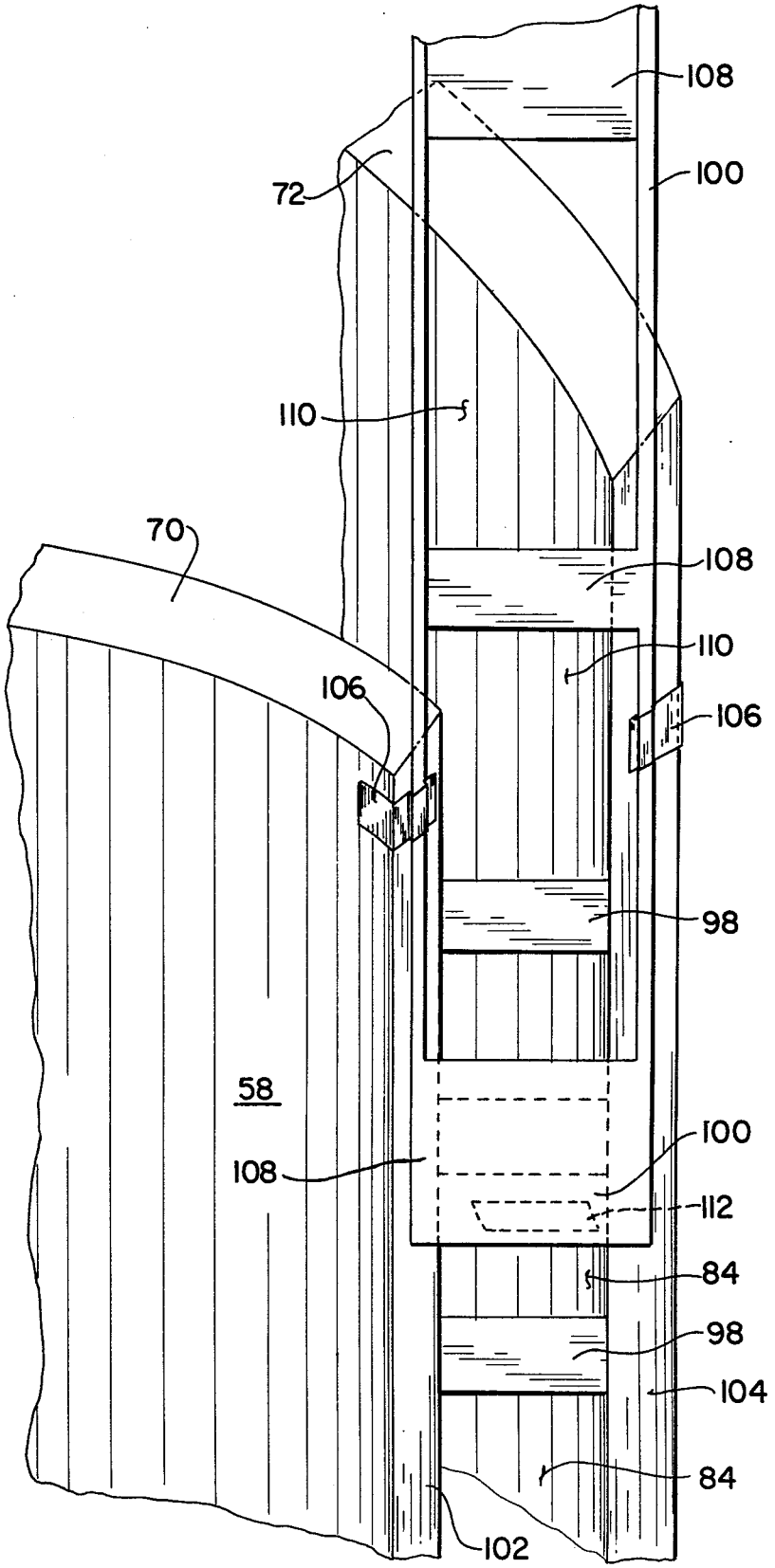
FIG. 6 is a perspective view of yet another embodiment in accordance with the invention, incorporating an adjustable insert.

It is to be understood that as the exemplary system disclosed can readily be modified in many manners without departing from the spirit of the invention, the disclosure is intended to be taken as illustrative, and not in a limiting sense. For example, the material and manner of construction, the specific shapes, sizes and positioning of the various components can readily be modified. It will further be recognized that the relative interaction of the component parts allows a tunability or proportioning of the flow distribution, and thus the thermal distribution, prior to construction of the components. Similar variabilities which can be controlled during actual operation are also possible. For example, FIG. 6 shows a simple structural arrangement for adjusting or proportioning the discharge from the vane 58 through use of a selectively positionable insert 100. The insert 100 is slidably held adjacent edges 102, 104 of the respective interior shell 70 and exterior shell 72 by ribs 106 or other holding means. The ribs can be intermittent or continuous along the length of the vane. The insert 100 can similarly be positioned within guiding grooves internally of the vane 58, or any other structure which allows the insert to selectively cover all or portions of the slots 84 between the sheets 98. The insert 100 is of any convenient construction, and can include closing surfaces 108 as well as apertures 110. It will be apparent that the closing surfaces 108, apertures 110, and sheets 98 can be modified as to shape and orientation so as to acheive a desired control of the flow rate, position and direction of the gaseous medium flow stream discharged from the vane 58. The inserts can additionally include fins 112 to adjust flow direction. Many other modifications and additions are equally possible.

I claim:

1. In fluid treatment apparatus of the type wherein a first fluid medium stream flowing in a first direction and at a first temperature is turned and is mixed with a second fluid medium stream at a second temperature, the improvement comprising:

a plurality of airfoil shaped turning vanes, having a leading edge and a trailing edge, disposed within said first stream, said vanes having an interior space, means for inletting said second stream into said interior space, a slot along said trailing edge for discharging said second inletted stream into said first fluid medium and a selectively movable insert to deflect the flow of said second stream through said slot.

2. A vane for turning a first gaseous medium stream at a first temperature and for mixing a second gaseous medium stream at a different temperature with said first stream comprising an aerodynamically shaped double thickness vane having an interior space, a length and a trailing edge, an opening for inletting said second medium into said interior space, a discharge slot along at least a selected portion of said length, said discharge slot being positioned at said trailing edge, and selectively movable means for adjusting the size of said slot.

3. A vane for turning a first gaseous medium stream at a first temperature and for mixing a second gaseous medium stream at a different temperature with said first stream comprising an aerodynamically shaped double thickness vane having an interior space, a length and a trailing edge, an opening for inletting said second medium into said interior space, a discharge slot along at least a selected portion of said length, said discharge slot being positioned at said trailing edge, and selectively movable means for deflecting the flow of said second medium through said slot.

4. Apparatus comprising a turning and mixing vane including an airfoil shaped exterior, a trailing edge and an interior space, means for inletting a gaseous medium into said interior space, and means for discharging said inletted gaseous medium along said trailing edge including a slot along said trailing edge, and further comprising selectively movable means for adjusting the size of said slot.

5. A method of turning a first gaseous medium stream at a first temperature and of mixing said first stream with a second gaseous medium stream at a different temperature, comprising:

flowing said first stream about an airfoil shaped vane having an interior space and an exterior configured to turn said stream from a first direction at the leading edge of said airfoil to another direction at the trailing edge of said airfoil;

flowing said second stream at a different temperature into said interior space; and flowing said second stream at a different temperature from said interior space into said first stream at said trailing edge.

6. A method of turning a first fluid medium stream at a first temperature and of mixing said first stream with a second fluid medium stream at a different temperature, comprising:

flowing said first stream about an airfoil shaped vane having an interior space and an exterior configured to turn said stream from a first direction at the leading edge of said airfoil to another direction at the trailing edge of said airfoil;

flowing said second stream at a different temperature into said interior space; and flowing said second stream at a different temperature from said interior space into said first stream at said trailing edge.

* * * * *